US009924266B2

(12) United States Patent
Sorensen

(10) Patent No.: US 9,924,266 B2
(45) Date of Patent: Mar. 20, 2018

(54) AUDIO SIGNAL PROCESSING

(71) Applicant: Microsoft Technology Licensing, LLC, Redmond, WA (US)

(72) Inventor: Karsten Vandborg Sorensen, Stockholm (SE)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 38 days.

(21) Appl. No.: 14/258,689

(22) Filed: Apr. 22, 2014

(65) Prior Publication Data

US 2015/0222988 A1 Aug. 6, 2015

(51) Int. Cl.
*H04R 3/00* (2006.01)
*G10L 21/0208* (2013.01)

(52) U.S. Cl.
CPC ..... *H04R 3/002* (2013.01); *G10L 21/0208* (2013.01)

(58) Field of Classification Search
CPC ..... G10K 11/175; G10K 2210/3056; G10L 25/78
USPC ..... 381/71.1, 71.7, 71.8, 71.11
See application file for complete search history.

(56) References Cited

U.S. PATENT DOCUMENTS 6,563,931 B1 * 5/2003 Soli ..... H04R 25/505 381/318
7,016,507 B1 3/2006 Brennan
7,454,332 B2 11/2008 Koishida et al.
7,555,075 B2 6/2009 Pessoa et al.
8,185,389 B2 5/2012 Yu et al.
8,538,763 B2 9/2013 Yu
2007/0237271 A1 * 10/2007 Pessoa ..... G10L 21/0208 375/346
2008/0147387 A1 6/2008 Matsubara et al.
2009/0010453 A1 1/2009 Zurek et al.
2009/0304191 A1 * 12/2009 Hoang Co Thuy . G10L 21/0208 381/57

(Continued)

FOREIGN PATENT DOCUMENTS

EP 1211671 6/2002

OTHER PUBLICATIONS

Rosenstrauch, "Sound Connections with Environmental Optimizer II", Available at <http://www.resound.com/~/media/DownloadLibrary/ReSound/White%20papers/environmental-optimizer-II-white-paper.pdf>, Dec. 17, 2013, 5 pages.

(Continued)

*Primary Examiner* — George Monikang

(57) ABSTRACT

Disclosed is an audio signal processing device comprising an input for receiving a noisy audio signal, a variable gain component and a noise suppression component. The noisy audio signal has a desired audio component and a noise component. The variable gain component and the noise suppression component are respectively configured to apply a gain and a noise suppression procedure to the audio signal, thereby generating a gain adjusted noise reduced audio signal. The aggressiveness of the noise suppression procedure is rapidly changed responsive to a change in the applied gain. That change is a change from a current value by an amount substantially matching the change in applied gain to a new value. The aggressiveness is then gradually returned to the current value.

20 Claims, 9 Drawing Sheets

(56) References Cited

U.S. PATENT DOCUMENTS

| | | | | |
|---|---|---|---|---|
| 2009/0313009 | A1* | 12/2009 | Kovesi | G10L 19/24 704/203 |
| 2011/0013792 | A1* | 1/2011 | Iwano | H04R 25/356 381/317 |
| 2013/0262101 | A1 | 10/2013 | Srinivasan | |
| 2014/0211965 | A1* | 7/2014 | Hetherington | G10L 21/0208 381/94.2 |

OTHER PUBLICATIONS

"International Search Report and Written Opinion", Application No. PCT/US2015/013158, dated Apr. 24, 2015, 9 Pages.
"International Preliminary Report on Patentability", Application No. PCT/US2015/013158, dated Feb. 16, 2016, 5 pages.

* cited by examiner

AUDIO SIGNAL PROCESSING

BACKGROUND

This application claims priority under 35 USC §119 or § 365 to Great Britain Patent Application No. 1401689.3 entitled "Audio Signal Processing" filed Jan. 31, 2014 by Karsten Vandborg Sorensen the disclosure of which is incorporate in its entirety.

Audio signal processing refers to the intentional altering of an audio signal to achieve a desired effect. It may occur in the analogue domain, digital domain or a combination of both and may be implemented, for instance, by a generic processor running audio processing code, specialized processors such as digital signal processors having architectures tailored to such processing, or dedicated audio signal processing hardware. For example, audio captured by a microphone of a user device may be processed prior to and/or following transmission over a communication network as part of a voice or video call.

An audio signal may be processed by an audio processing chain comprising a plurality of audio signal processing components (hardware and/or software) connected in series; that is whereby each component of the chain applies a particular type of audio signal processing (such as gain, dynamic range compression, echo cancellation etc.) to an input signal and supplies that processed signal to the next component in the chain for further processing, other than the first and last components which receive as an input an initial analogue audio signal (e.g. a substantially unprocessed or 'raw' audio signal as captured from a microphone or similar) and supply a final output of the chain (e.g. for supplying to a loudspeaker for play-out or communication network for transmission) respectively. Thus variations in processing by one component in the chain can cause variations in the output of subsequent components in the chain.

One type of audio processing component that may be used in such a chain is a noise suppression component. The audio signal may comprise a desired audio component but also an undesired noise component; the noise suppression component aims to suppress the undesired noise component whilst retaining the desired audio component. For instance, an audio signal captured by a microphone of a user device may capture a user's speech in a room, which constitutes the desired component in this instance. However, it may also capture undesired background noise originating from, say, cooling fans, environmental systems, background music etc.; it may also capture undesired signals originating from a loudspeaker of the user device for example received from another user device via a communication network during a call with another user conducted using a communication client application, or being output by other applications executed on the user device such as media applications—these various undesired signals can all contribute to the undesired noise component of the audio signal.

SUMMARY

Disclosed is an audio signal processing device comprising an input for receiving a noisy audio signal, a variable gain component and a noise suppression component. The noisy audio signal has a desired audio component and a noise component. The variable gain component and the noise suppression component are respectively configured to apply a gain and a noise suppression procedure to the audio signal, thereby generating a gain adjusted noise reduced audio signal. The aggressiveness of the noise suppression procedure is rapidly changed responsive to a change in the applied gain. That change is a change from a current value by an amount substantially matching the change in applied gain to a new value. The aggressiveness is then gradually returned to the current value.

An equivalent method and computer program product configured to implement that method are also disclosed.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Nor is the claimed subject matter limited to implementations that solve any or all of the disadvantages noted in the Background section.

BRIEF DESCRIPTION OF FIGURES

For a better understanding of the present subject matter and to show how the same may be carried into effect, reference will now be made by way of example to the accompanying drawings in which.

DETAILED DESCRIPTION

The present disclosure considers a situation in which a variable gain component and a noise suppression (noise reduction) component are connected in series and are respectively configured to receive and process a noisy audio signal (e.g. a microphone signal) having a desired audio component (e.g. a speech signal) and a noise component (e.g. background noise). The variable gain component is configured to apply a changeable gain to its input. It may, for instance be an automatic gain component configured to automatically adjust the applied gain in order to maintain a desired average signal level (automatic gain control being known in the art) or a manual gain component configured to adjust the applied gain in response to suitable a user input. The noise suppression component is configured to apply a noise suppression procedure to its input in order to suppress the noise component of the audio signal e.g. by applying a spectral subtraction technique whereby the noise component is estimated during periods of speech inactivity, and a noise reduced signal is estimated from the noisy audio signal using the noise component estimate (spectral subtraction being known in the art). The noise suppression component and the variable gain component constitute a signal processing chain configured to generate a gain adjusted estimate of the desired audio component.

In order to improve perceptual quality, the noise suppression procedure may be configured such that the level of the noise component is attenuated relative to the original noisy signal but intentionally not removed in its entirety (even if the estimate of the noise component is near-perfect). That is, such that a noise component is always maintained in the noise reduced signal estimate albeit at a level which is reduced relative to the noisy audio signal such that a 'fully' clean signal is intentionally not output.

Whilst this does have the effect of improving perceptual quality, an unintended consequence is that a change in the gain applied by the variable gain component causes a noticeable change in the level of the noise component remaining in the noise reduced signal estimate; this can be annoying for a user.

In accordance with the present subject matter, the noise suppression component is configured to be responsive to such a change in the gain applied by the variable gain component in a way that makes this change more transparent (that is less noticeable) to the user. To an extent, the disclosed subject matter is about "decoupling" the respective changes in level of the desired audio component and the noise component, thereby enabling one gain adaptation speed for changing the desired signal level, and another for changing the noise level. Before describing particular embodiments, a context in which the subject matter can be usefully applied will be described.

Figure 1:
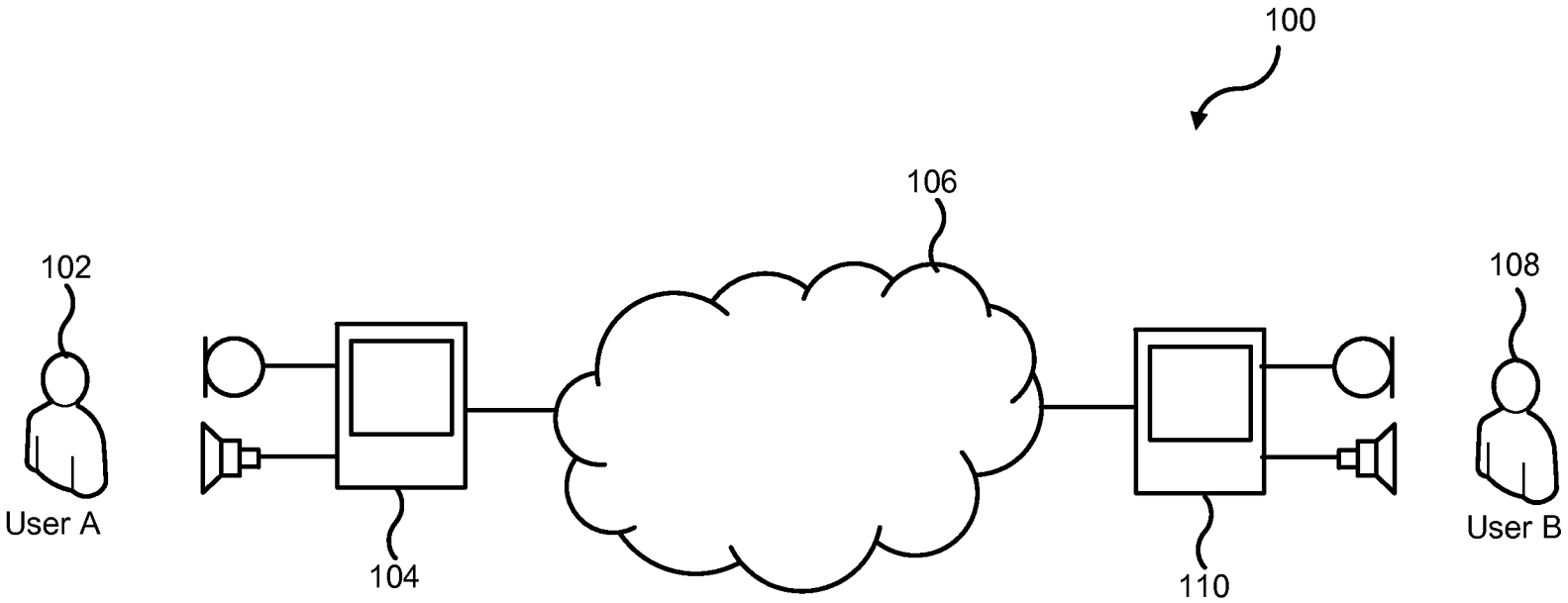
FIG. 1 is a schematic illustration of a communication system.

FIG. 1 shows a communication system 100 comprising a first user 102 ("User A") who is associated with a first user device 104 and a second user 108 ("User B") who is associated with a second user device 110. In other embodiments the communication system 100 may comprise any number of users and associated user devices. The user devices 104 and 110 can communicate over the network 106 in the communication system 100, thereby allowing the users 102 and 108 to communicate with each other over the network 106. The communication system 100 shown in FIG. 1 is a packet-based communication system, but other types of communication system could be used. The network 106 may, for example, be the Internet. Each of the user devices 104 and 110 may be, for example, a mobile phone, a tablet, a laptop, a personal computer ("PC") (including, for example, Windows™, Mac OS™ and Linux™ PCs), a gaming device, a television, a personal digital assistant ("PDA") or other embedded device able to connect to the network 106. The user device 104 is arranged to receive information from and output information to the user 108 of the user device 110. The user device 104 comprises output means such as a display and speakers. The user device 104 also comprises input means such as a keypad, a touch-screen, a microphone for receiving audio signals and/or a camera for capturing images of a video signal. The user device 104 is connected to the network 106.

The user device 104 executes an instance of a communication client, provided by a software provider associated with the communication system 100. The communication client is a software program executed on a local processor in the user device 104. The client performs the processing required at the user device 104 in order for the user device 104 to transmit and receive data over the communication system 100.

The user device 110 corresponds to the user device 104 and executes, on a local processor, a communication client which corresponds to the communication client executed at the user device 104. The client at the user device 110 performs the processing required to allow the user 108 to communicate over the network 106 in the same way that the client at the user device 104 performs the processing required to allow the user 102 to communicate over the network 106. The user devices 104 and 110 are endpoints in the communication system 100.

FIG. 1 shows only two users (102 and 108) and two user devices (104 and 110) for clarity, but many more users and user devices may be included in the communication system 100, and may communicate over the communication system 100 using respective communication clients executed on the respective user devices.

The audio signal captured by the microphone of the first user device 104 is transmitted over the network 106 for playing out by the second user device 110 e.g. as part of an audio or video call conducted between the first and second users 102, 108 using the first and second user devices 104, 110 respectively.

Figure 2:
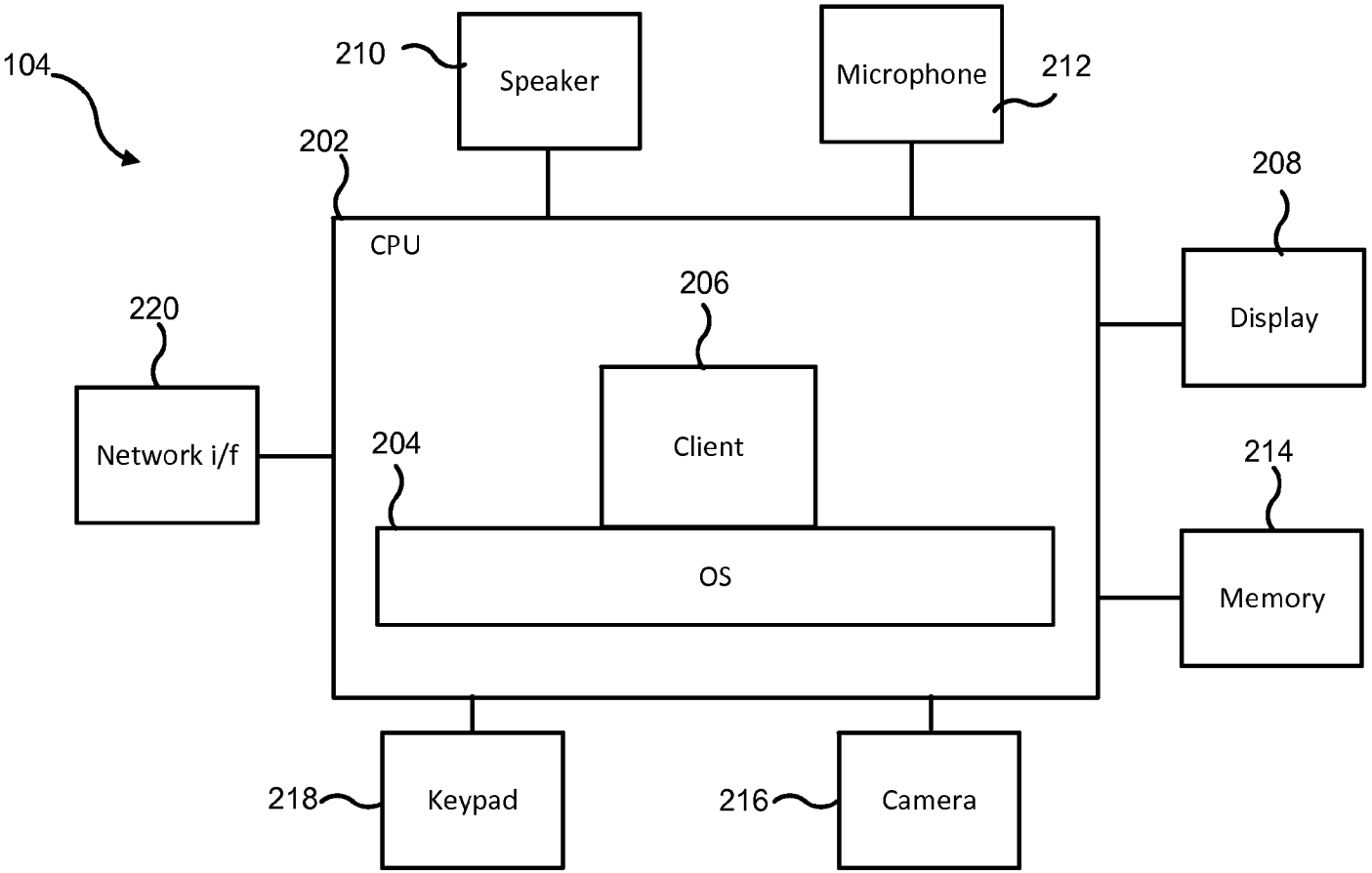
FIG. 2 is a block diagram of a user device.

FIG. 2 illustrates a detailed view of the user device 104 on which is executed the communication client instance 206 for communicating over the communication system 100. The user device 104 comprises a central processing unit ("CPU") or "processing module" 202, to which is connected: output devices such as a display 208, which may be implemented as a touch-screen, and a speaker (or "loudspeaker") 210 for outputting audio signals; input devices such as a microphone 212 for receiving analogue audio signals, a camera 216 for receiving image data, and a keypad 218; a memory 214 for storing data; and a network interface 220 such as a modem for communication with the network 106. The user device 104 may comprise other elements than those shown in FIG. 2. The display 208, speaker 210, microphone 212, memory 214, camera 216, keypad 218 and network interface 220 may be integrated into the user device 104 as shown in FIG. 2. In alternative user devices one or more of the display 208, speaker 210, microphone 212, memory 214, camera 216, keypad 218 and network interface 220 may not be integrated into the user device 104 and may be connected to the CPU 202 via respective interfaces. One example of such an interface is a USB interface. If the connection of the user device 104 to the network 106 via the network interface 220 is a wireless connection then the network interface 220 may include an antenna for wirelessly transmitting signals to the network 106 and wirelessly receiving signals from the network 106.

FIG. 2 also illustrates an operating system ("OS") 204 executed on the CPU 202. Running on top of the OS 204 is software of the client instance 206 of the communication system 100. The operating system 204 manages the hardware resources of the computer and handles data being transmitted to and from the network 106 via the network interface 220. The client 206 communicates with the operating system 204 and manages the connections over the communication system. The client 206 has a client user interface which is used to present information to the user 102 and to receive information from the user 102. In this way, the client 206 performs the processing required to allow the user 102 to communicate over the communication system 100.

Figure 3:
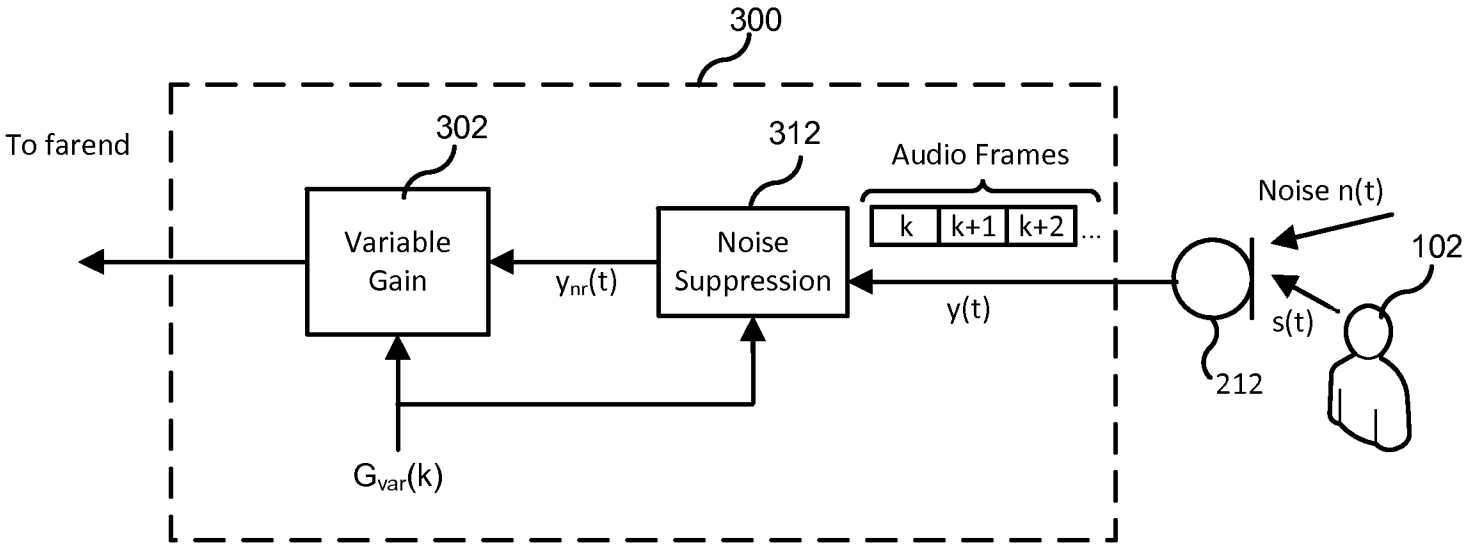
FIG. 3 is a function block diagram of an audio signal processing technique.
Figure 4:
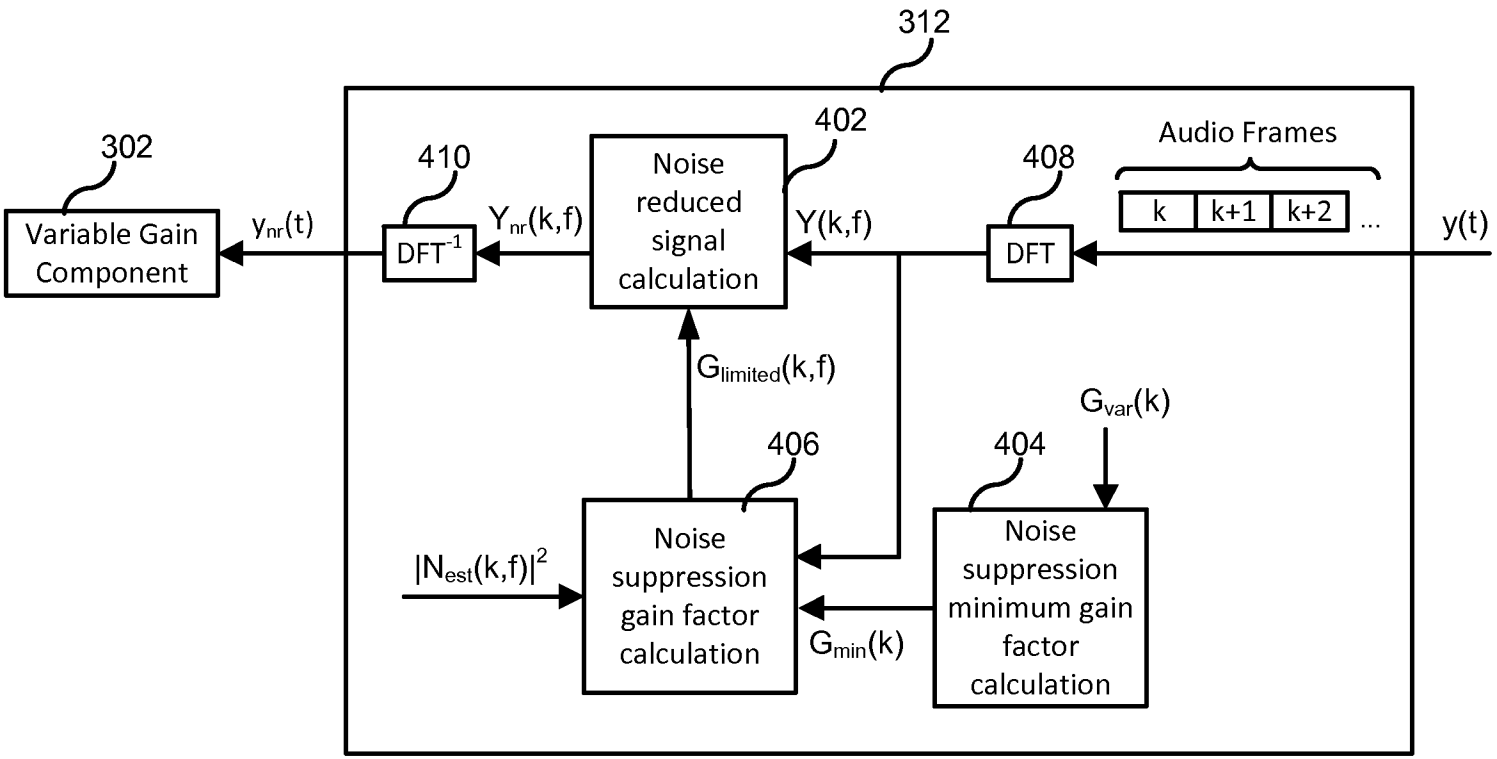
FIG. 4 is a function block diagram of a noise suppression technique.
Figure 5:
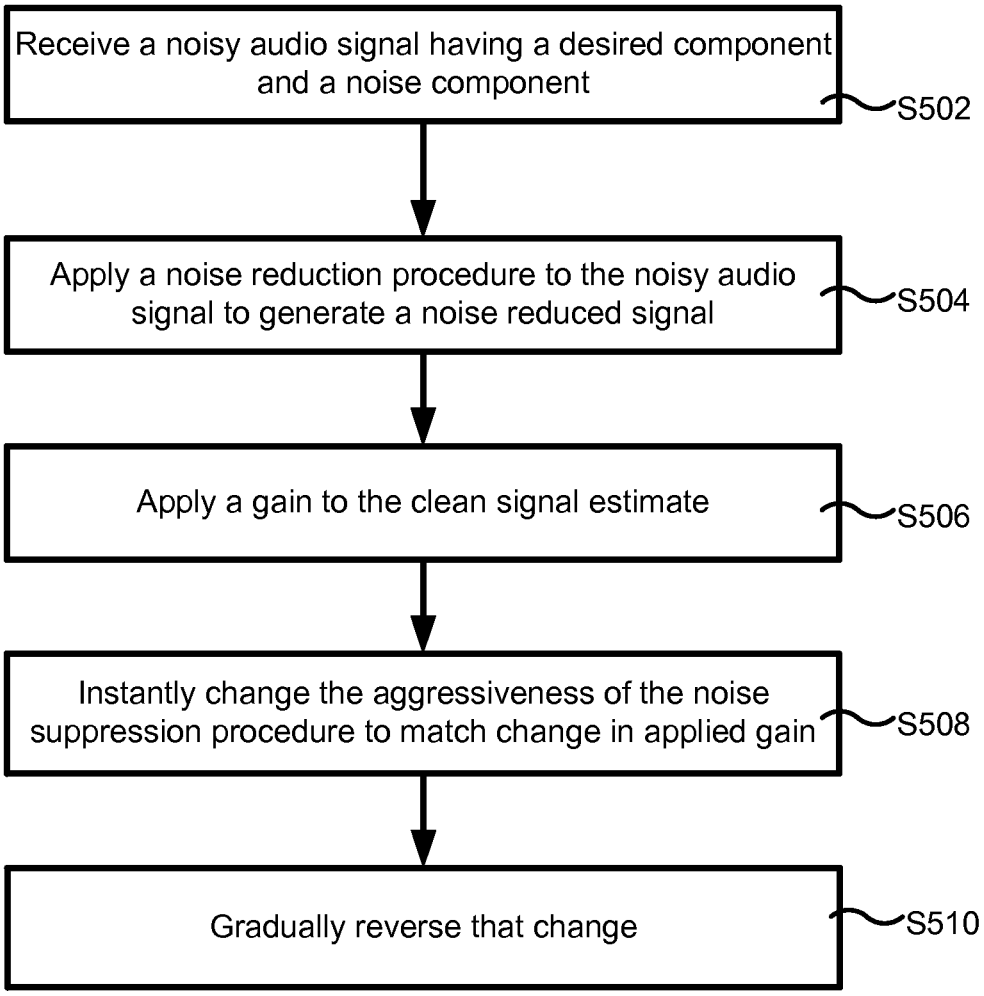
FIG. 5 is a schematic flow chart of an audio signal processing method.

With reference to FIGS. 3, 4 and 5 there is now described an audio signal processing method. FIG. 3 is a functional diagram of a part of the user device 104.

As shown in FIG. 3, the first user device 104 comprises the microphone 212, and an audio signal processing system 300. The system 300 represents the audio signal processing functionality implemented by executing communication client application 206 on the CPU 202 of device 104.

The system 300 comprises a noise suppression component 312 and a variable gain component 302. The variable gain component 302 has a first input which is connected to an output of the noise reduction component 312, a second input connected to receive a gain factor $G_{var}(k)$ and an output connected to supply a processed audio signal for further processing, including packetization, at the first user device 104 before transmission to the second user device 108 over the network 106 (e.g. as part of a voice or video call). The noise suppression component 312 has a first input connected to receive the microphone signal y(t)—having a desired audio component s(t) and a noise component n(t)—from the microphone 212, and a second input connected to receive the gain factor $G_{var}(k)$. The noise reduction component 312 and variable gain component 302 are thus connected in series and constitute a signal processing chain, the first input of the noise reduction component being an input of the chain and the output of the variable gain component being an output of the chain.

The microphone 212 is shown as supplying the microphone signal to the signal processing chain directly for the sake of convenience. As will be appreciated, the microphone may in fact supply the microphone signal y(t) via other signal processing components such as analogue-to-digital converter components.

The variable gain component 302 component applies an amount of gain defined by the gain factor $G_{var}(k)$ to its first input signal to generate a gain adjusted signal. The noise suppression component applies a noise suppression procedure to its first input signal to generate an estimate of the desired audio component thereof. This is described in detail below.

FIG. 4 is a functional diagram showing the noise suppression component 312 in more detail. The noise suppression component comprises a noise reduced signal calculation component 402, a noise suppression minimum gain factor calculation component 404, a noise suppression gain factor calculation component 406, a (discrete) Fourier transform component 408 and an inverse (discrete) Fourier transform component 410. The Fourier transform component 408 has an input connected to receive the microphone signal y(t). The noise reduced signal calculation component has a first input connected to an output of the Fourier transform component 408 and a second input connected to an output of the noise suppression gain factor calculation component 406. The inverse Fourier transform component has an input connected to an output of the noise reduced signal calculation component 410 and an output connected to the variable gain component 302 of the signal processing system 300.

The noise suppression minimum gain factor calculation component 404 has an input connected to receive the gain factor $G_{var}(k)$, and an output connected to a first input of the noise suppression gain factor calculation component 406. The noise suppression gain factor calculation component 406 also has a second input connected to receive a noise signal power estimate $|N_{est}(k,f)|^2$ and a third input connected to the output of the Fourier transform component 408.

Audio signal processing is performed by the system 300 on a per-frame basis, each frame k, k+1, k+2 . . . being e.g. between 5 ms and 20 ms in length. The variable gain component 302 and the noise suppression component 312 each receive respective input audio signals as a plurality of input sequential audio frames and provide respective output signals as a plurality of output sequential audio frames.

The Fourier transform component 408 performs a discrete Fourier transform operation on each audio frame k to calculate a spectrum Y(k,f) for that frame. The spectrum Y(k,f) can be considered a representation of a frame k of the microphone signal y(t) in the frequency domain. The spectrum Y(k,f) is in the form of a set of spectral bins e.g. between 64 and 256 bins per frame, with each bin containing information about a signal component at a certain frequency (that is in a certain frequency band). For dealing with wideband signals, a frequency range from e.g. 0 to 8 kHz may be processed, divided into e.g. 64 or 32 frequency bands. The bands may or may not be of equal width—they could for instance be adjusted in accordance with the Bark scale to better reflect critical bands of human hearing.

The noise suppression minimum gain factor calculation component 404 calculates, on a per-frame k basis, a noise suppression minimum gain factor $G_{min}(k)$ which is supplied to the noise reduction gain factor calculation component 406. The noise reduction gain factor calculation component 406 calculates, on a per-frame k basis, a noise suppression gain factor $G_{limited}(k,f)$ which is supplied to the noise reduced signal calculation component 402. The noise reduced signal calculation component 402 calculates a frequency-domain noise reduced signal estimate $Y_{nr}(k,f)$ which is supplied to the variable gain component 302. The noise reduced signal estimate $Y_{nr}(k,f)$ for a frame k is calculated by adjusting the spectrum Y(k,f) for that frame by an amount specified by the noise suppression gain factor $G_{limited}(k,f)$; that is, by applying a frequency-dependent gain $G_{limited}(k,f)$ across the spectrum Y(k,f) to reduce the contribution of the noise component n(t) to the spectrum of the microphone signal y(t) relative to that of the desired audio component s(t).

The inverse Fourier transform component performs an inverse discrete Fourier transform operation on the frequency-domain noise reduced signal estimate $Y_{nr}(k,f)$—that operation being the inverse of the Fourier transform operation performed by the Fourier transform component 408—to calculate a time-domain noise reduced signal estimate $y_{nr}(t)$. The noise component n(t) is still (intentionally) present in the noise reduced signal $y_{nr}(t)$ but at a lower level than in the noisy microphone signal y(t). The noise reduced signal estimate is provided by the noise suppression component as a plurality of sequential clean-signal-estimate audio frames. The Fourier transform and inverse Fourier transform operations could, in practice, be implemented as fast Fourier transform operations.

The functionality and interaction of these noise suppression components will be described in more detail below.

The variable gain component 302 performs a gain adjustment of the noise reduced signal $y_{nr}(t)$ to generate a gain adjusted audio signal by applying, to each frame k, an amount of gain defined by the variable gain factor $G_{var}(k)$ to that frame k of the time-domain noise reduced signal estimate $y_{nr}(t)$. The gain adjusted audio signal is provided by the variable gain component as a plurality of sequential gain-adjusted-signal audio frames. Alternatively, the inverse Fourier transform may be disposed after the variable gain component 302 in the system 300 such that the gain adjustment is performed in the frequency domain rather than the time domain.

The gain factor $G_{var}(k)$ may vary between frames and, in embodiments, may also vary inside a frame (from sample-to-sample). For instance, $G_{var}(k)$ may be varied inside a frame by smoothing approaching a corrected value.

Alternatively, the positions of the variable gain component 302 and the noise reduction component 312 may be reversed relative to their arrangement as depicted in FIGS. 3 and 4 such that the variable gain component 302 and the noise suppression component 312 are still connected in series, but with the first input of the variable gain component connected to receive the microphone signal y(t), and the first input of the noise suppression component 312 connected to the output of the variable gain component 302. That is, the positions of components 302, 312 in the signal processing chain may be reversed. In this case, the variable gain component applies a gain to the microphone signal y(t) to generate a gain adjusted signal, and the noise suppression component applies a noise suppression procedure to the gain adjusted signal to generate an estimate of the desired audio component thereof.

The signal processing chain may also comprise other signal processing components (not shown), connected before, after and/or in between the noise reduction component 312 and the variable gain component 302. That is, the signal processing functionality implemented by executing communication client application 206 may include more signal processing functionality than that shown in FIG. 3 which may be implemented prior to, after, and/or in between processing by components 302, 312 (with the functionality of components 302, 312 being implemented in either order relative to one another).

The aggregate functionality of the noise reduction component and the variable gain component is to apply, as part of the signal processing method, a combination of a gain and a noise reduction procedure to the noisy audio signal y(t) thereby generating a gain adjusted, noise reduced audio signal having a noise-to-signal power ratio which is reduced relative to the noisy audio signal y(t). This is true irrespective of their order and/or disposition in the signal processing chain (that is, irrespective of the temporal order in which the gain and the noise suppression procedure are applied in series relative to one another and/or relative to any other audio signal processing if performed on the audio signal in series with the application of the gain and noise suppression).

The audio signal processing method will now be described in detail with reference to FIG. 5, which is a flow chart for the method.

The method involves adjusting the aggressiveness of the noise suppression procedure to apply more noise reduction immediately following a gain increase (and the opposite for a decrease) and then slowly returning to 'regular' aggressiveness afterwards, 'regular' aggressiveness being a level of aggressiveness which is chosen to optimize the perceptual quality of the noise suppression procedure. Here, the "aggressiveness" of the noise suppression procedure is a measure of the extent to which the contribution of the noise component to overall signal level is reduced by the noise suppression procedure and can be quantified, for instance, as an amount by which signal power of the noise component is reduced relative to that of the desired audio component by the noise suppression procedure. Typically, the 'regular' aggressiveness will be set so as to ensure that some noise always remains after noise reduction albeit at a level which is reduced relative to that prior to noise reduction, rather than being completely removed—as discussed above, this is for reasons of enhanced perceptual quality.

The aggressiveness of the noise suppression procedure is changed by an amount substantially matching the change in applied gain. Matching the change in the aggressiveness of the noise suppression to the change in applied gain counteracts the effect that the change in applied gain would otherwise have on the level of the noise component remaining in the noise reduced signal estimate (i.e. prevents a 'jump' in the level of the remaining noise that would otherwise occur due to the 'jump' in applied gain) such that, immediately following the change in applied gain, the level of the noise remaining in the noise reduced signal estimate is substantially unchanged despite the change in the applied gain, with the applied gain thereby acting only to change the level of the desired audio component as intended and not the level of the noise component immediately following the change in applied gain.

It is still desirable to eventually return the aggressiveness to the 'regular' level to retain optimal perceptual quality, which will almost certainly cause a change in the level of the noise remaining in the signal estimate; however, making the change in the aggressiveness a gradual change ensures that this noise level change is also a gradual, rather than rapid, change. The level of the audible noise that remains in the gain adjusted noise reduced signal estimate after noise suppression thus varies more slowly than it otherwise would, making the adjustment of the gain less noticeable to the user while preserving the desired adjustment of the desired audio component.

Background noise reduction (BNR)—including, but not limited to, power spectral subtraction and other forms of spectral subtraction such as magnitude spectral subtraction—often applies a noise reduction limit or "target" which limits the extent of the noise reduction that can be applied to the noisy audio signal in order to generate a noise reduced signal estimate (that is, which restricts the amount by which the magnitude or power of the noise component can be reduced by the noise suppression procedure). In this case, the limit sets the aggressiveness of the noise reduction, thus the aggressiveness can be adjusted by adjusting this limit. Often, this limit can be expressed as a minimum gain or maximum attenuation (these being the multiplicative inverse of one another when expressed as a ratio of a signal to a gain adjusted signal and the additive inverse of one another when expressed on a logarithmic scale such as dB) that can be applied to the noisy audio signal at any given time for the purposes of reducing the power or magnitude of the noise component. A lower attenuation (greater gain) limit causes less aggressive noise suppression and a greater attenuation (lower gain) limit causes more aggressive noise suppressions. The limit may take a constant value of e.g. 12 dB of attenuation (−12 dB of gain), 12 dB being the maximum permissible noise suppression attenuation (−12 dB being the minimum permissible noise suppression gain) that can be applied to the noisy audio signal to generate a noise reduced signal estimate. Choosing a non-zero limit ensures that the noise component always remains in the noise reduced signal estimate albeit at a reduced level relative to the original noisy audio signal, rather than being completely removed (discussed above). 12 dB is widely recognized as a good trade-off between noise reduction and speech distortion—for comparison, e.g., 18 dB would be considered to be slightly aggressive, and would in extreme cases lead to audible speech distortion.

In embodiments, it is this noise reduction attenuation limit/target that is rapidly increased (resp. decreased) from a current value (e.g. 12 dB) by substantially the same amount as the gain has been increased (resp. decreased) by, and then gradually returned to that current value (e.g. 12 dB). For example, in response an increase (resp. decrease) in the applied gain of 3 dB, the noise reduction attenuation limit might be immediately changed to 12 db+3 db=15 dB (resp. 12 dB−3 dB=9 dB), and then gradually returned to 12 dB.

At step S502, the client 206 receives the noisy audio signal y(t) having the desired audio component s(t) and the noise component n(t) from the microphone 212. The noisy audio signal y(t) can be considered a sum of the noise component n(t) and the desired component s(t). Here, the desired component s(t) is a speech signal originating with the user 102; the noise signal n(t) may comprise background noise signals and/or undesired audio signals output from the loudspeaker 210 as discussed above.

At step S504, the noise suppression component 312 applies a noise suppression procedure to the audio signal y(t). In this embodiment, the noise suppression component applies a type of power spectral subtraction. Spectral subtraction is known in the art and involves estimating a power of the noise component n(t) during periods of speech inactivity (i.e. when only the noise component n(t) is present in the microphone signal y(t)). A noise signal power estimate $|N_{est}(k,f)|^2$ for a frame k may, for example, be calculated recursively during periods of speech inactivity (as detected using a known voice activity detection procedure) as $$|N_{est}(k,f)|^2=b*|N_{est}(k-1,f)|^2+(1-b)*|Y(k,f)|^2$$

where b is a suitable decay factor between 0 and 1. That is, as the noise signal power estimate $|N_{est}(k-1, f)|^2$ of the frame k−1 updated by a calculated signal power $|Y(k, f)|^2$ of the next adjacent frame k (calculated as the square of the magnitude of the spectrum Y(k, f) for frame k).

The noise component n(t) is (partially) suppressed in the audio signal y(t) by the noise reduced signal calculation component 402 applying to the audio signal spectrum Y(k,f) an amount of gain as defined by the noise suppression gain factor $G_{limited}(k,f)$, as follows:

$$|Y_{nr}(k,f)|^2=G_{limited}(k,f)^2*|Y(k,f)|^2$$

That is, a noise reduced signal power estimate $|Y_{nr}(k, f)|^2$ is obtained by multiplying the squared noise suppression gain factor $G_{limited}(k,f)$ with the signal power $|Y(k, f)|^2$ of the noisy audio signal y(t) (noise suppression gain thus being applied in the magnitude domain). Phase information for the original frame k is retained and can be used to obtain the noise reduced signal estimate $Y_{nr}(k, f)$ (that is, a noise reduced signal spectrum for frame k) from the power estimate $|Y_{nr}(k, f)|^2$. The time-domain noise reduced signal estimate $y_{nr}(t)$ is calculated by the inverse Fourier transform component 410 performing the inverse Fourier transform on the frequency domain noise reduced signal estimates (i.e. noise reduced signal spectra) for each frame in sequence.

An unlimited noise suppression gain factor $G_{unlimited}(k,f)$ is calculated by the noise suppression gain factor component 406 as:

$$G_{unlimited}(k, f) = \sqrt{\frac{|Y(k, f)|^2 - |N_{est}(k, f)|^2}{|Y(k, f)|^2}}.$$

The noise suppression gain factor $G_{limited}(k,f)$ is calculated as:

$$G_{limited}(k,f)=\max[G_{unlimited}(k,f),G_{min}(k)].$$

That is, as a maximum of the unlimited noise suppression gain factor $G_{unlimited}(k,t)$ and the noise suppression minimum gain factor $G_{min}(k)$. The unlimited noise suppression gain factor thus is applied to a frame k only to the extent that it is above the noise suppression minimum gain factor $G_{min}(k)$ for that frame k. Decreasing the lower gain limit $G_{min}$ (k) for a frame k increases the aggressiveness of the noise suppression procedure for that frame k as it permits a greater amount of noise signal attenuation; increasing the lower gain limit $G_{min}$ (k) decreases the aggressiveness of the noise reduction procedure for that frame k as it permits a lesser amount of noise signal attenuation.

In the absence of other considerations a lower limit of, say, −12 dB may be favoured in order to improve perceptual quality and, in known spectral subtraction techniques, the lower limit is typically fixed at around that value for this reason. In contrast, here, the lower limit $G_{min}$ (k) may vary from frame to frame (and, in embodiments, within a given frame—see below)—that is, the aggressiveness of the noise suppression procedure may vary from frame to frame (or within a given frame)—as required in order to track any changes in the gain applied by the variable gain component for reasons discussed above and in a manner that will be described in detail below.

At step S506, an amount of gain defined by the gain factor $G_{var}(k)$ is applied to the noise reduced signal estimate s(t) by the variable gain component 302. This applied gain can vary from one frame to the next frame (and as discussed may also vary within a given frame). The gain factor $G_{var}(k)$ is varied automatically as part of an automatic gain control (AGC) process such that the average or peak output of the noise reduced signal estimate s(t) is automatically adjusted to a desired level e.g. to maintain a substantially constant peak or average level even in the presence of signal variations. The automatic gain control process may, for instance, be employed throughout a voice or video call with the applied gain thus changing at points in time during the call. Alternatively or additionally, the gain factor $G_{var}(k)$ may be varied manually in response to a user input e.g. the user 102 electing to adjust their microphone level.

In this embodiment, the gain factor $G_{var}(k)$ varies from an initial value $G_{var,initial}$ as a to a new target value $G_{var,target}$. The variation from the initial value to the target value is a smooth variation in that the gain factor $G_{var}(k)$ varies from the initial value to the target value as a first (steep) function of time having a first time constant $\tau_1$. The time constant $\tau_1$ is a time it takes for the applied gain to change from the initial value $G_{var,initial}$ by (1−1/e)≈63% of the total amount $\Delta_1$ by which the applied gain eventually changes (i.e. $\Delta_1=G_{var,target}-G_{var,initial}$—that is a difference between the target value and the initial value); that is, $\tau_1$ is the time it takes for the applied gain to change from $G_{var,initial}$ to $G_{var,initial}+\Delta_1*(1-1/e)$. This may be effected, for instance, by first order recursive smoothing of $G_{var}(k)$ from the initial value to the target value by updating the applied gain $G_{var}(k)$ as per equation 1, below:

$$G_{var}(k)=G_{var,target}+d*[G_{var}(k-1)-G_{var,target}]$$

where 0<d<1 is a smoothing parameter which determines the first time constant $\tau_1$. When the gain factor $G_{var}(k)$ is smoothed as per equation 1, the gain factor changes exponentially towards the target $G_{var,target}$ as $G_{var,target}-\Delta_1*e^{-(t-t_0)/\tau_1}$ (this being the first function of time, the first function being substantially exponential) where t represents time and the change in gain begins at a time $t_0$.

Whilst smooth, the chance in the applied gain from the initial value to the target value is nonetheless a rapid change in that the first time constant has a value of around 50-250 ms (which can be achieved by setting the smoothing parameter d in equation 1 accordingly). In other words, a variable gain 'target' changes instantly (e.g. as a step function) to the new target value of $G_{var,target}$, and the applied gain $G_{var}(k)$ follows the gain target, rapidly but nonetheless smoothly moving towards the new target value in a short amount of time (that amount of time being dependent on both the first time constant $\tau_1$ and the amount $\Delta_1$ by which the applied gain changes). It is undesirable for the noise level to change this fast, particularly if the applied gain change is large (as this would result in a corresponding large, rapid change in the noise level).

Figure 6A:
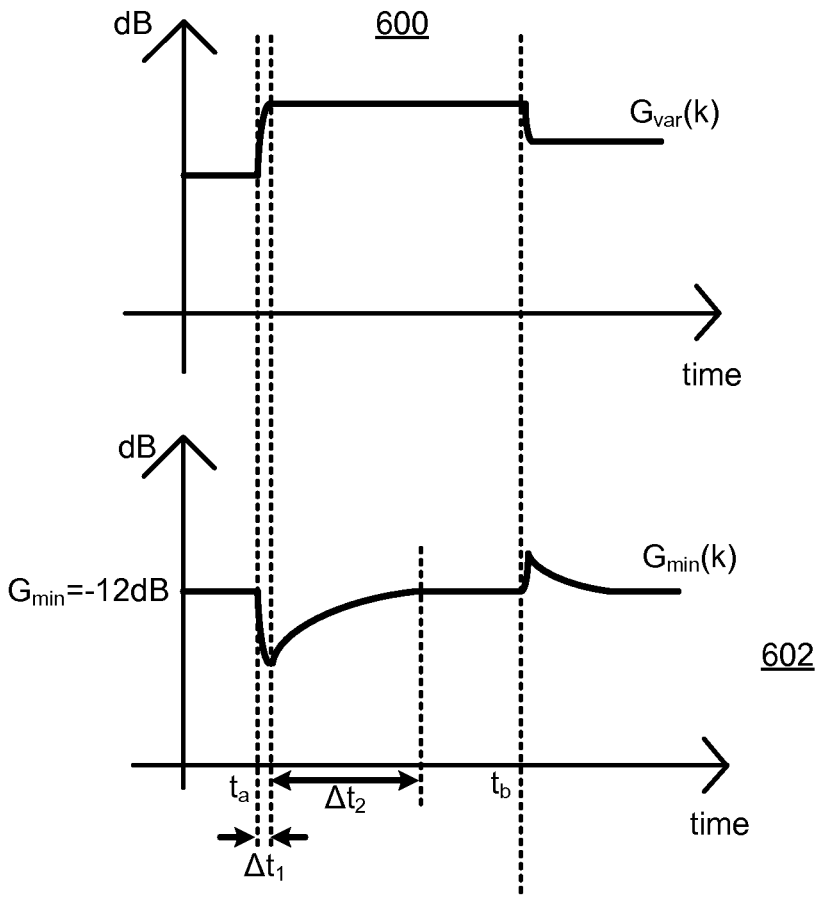
FIG. 6A is a schematic illustration of a time-varying applied gain and a time-varying noise suppression minimum gain.
Figure 6B:
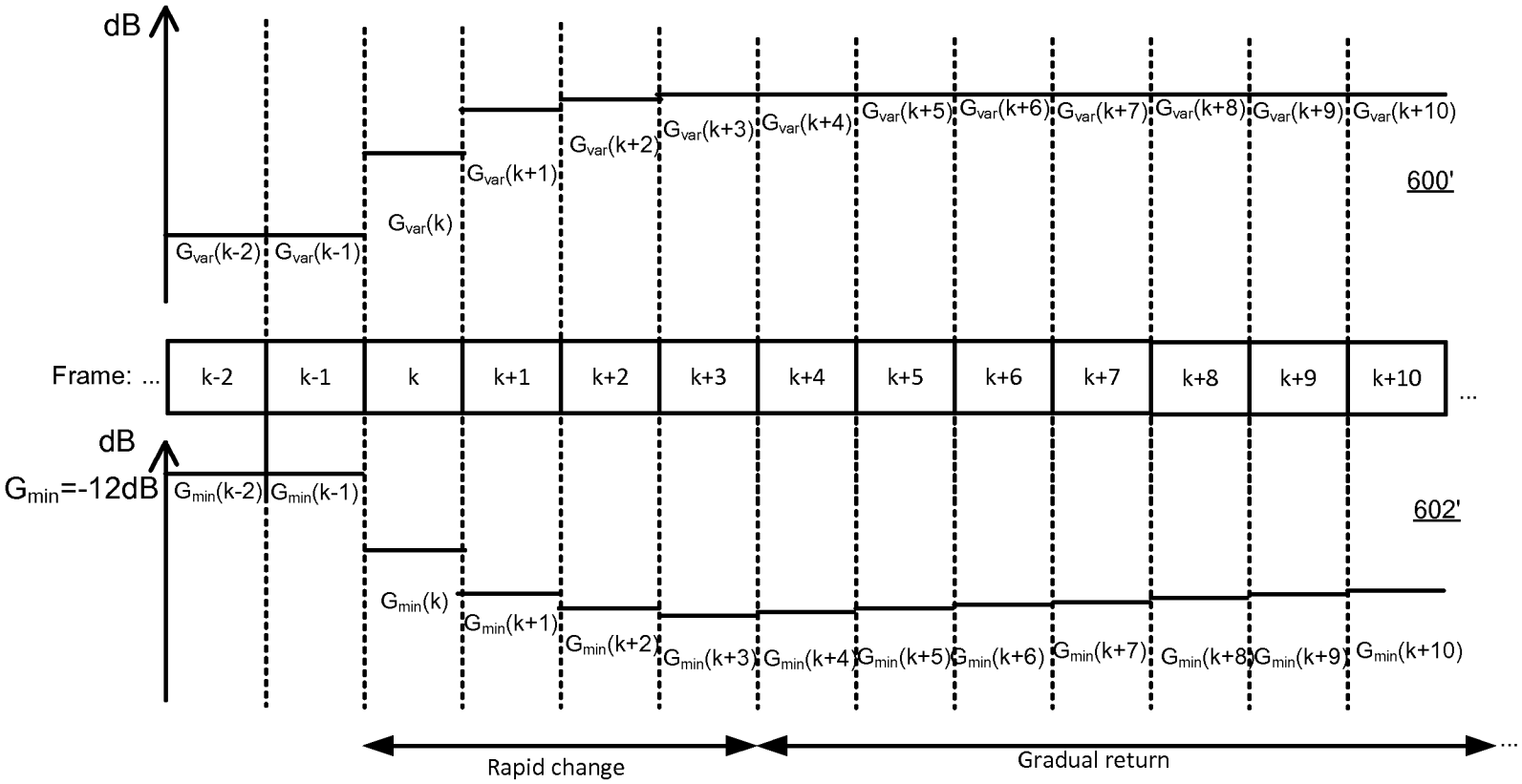
FIG. 6B is a schematic illustration of a time-varying applied gain and a time-varying noise suppression minimum gain at the audio frame level.

Exemplary variations in $G_{var}$ (k) are illustrated in graph 600 of FIG. 6A which shows exemplary variations in $G_{var}$ (k) with time over an interval in the order of 100 seconds and, at the frame level, in graph 600' of FIG. 6B (each frame being e.g. 5 ms-20 ms in duration). Although FIG. 600' shows $G_{var}$ (k) as varying from frame-to-frame but remaining constant across a given frame k for the sake of simplicity, in practice $G_{var}$ (k) may vary within frames (from sample-to-sample) e.g. by performing smoothing of the gain factor $G_{var}$ (k) on a per-sample (rather than per-frame) basis. At step S508, responsive to a change in the gain applied by the variable gain component 302, the aggressiveness of the noise suppression procedure performed by the noise suppression component 312 is changed from a current value by an amount substantially matching (i.e. in order to match the effect of) the change in applied gain to a new value, and then returned (S510) to the current value. The aggressiveness is rapidly changed from the current value to the new value, but then gradually returned to the current value as illustrated in graph 602 of FIG. 6A which shows exemplary variations in $G_{min}$ (k) with time over an interval in the order of 100 seconds and in graph 602' of FIG. 6B at the frame level (each frame being e.g. 5 ms-20 ms in duration). This is effected by varying the noise suppression minimum gain factor $G_{min}$ (k)—which, as discussed, sets the aggressiveness of the noise suppression procedure—in the manner described below.

The noise suppression minimum gain factor $G_{min}$ (k) as used for a frame k is calculated (updated) in the linear domain as per equation 2, below:

$$G_{min}(k) = \begin{cases} G_{min}(k-1) * \left[\dfrac{G_{var}(k-1)}{G_{var}(k)}\right] & \text{if } G_{var}(k) \neq G_{var}(k-1); \\ G_{min} + c * [G_{min}(k-1) - G_{min}] & \text{otherwise} \end{cases}$$

with c being a smoothing factor between 0 and 1. Thus, for example, if the applied gain $G_{var}$(k) is doubled (resp. halved), the noise suppression lower-limit $G_{min}$(k) is halved (resp. doubled) in order to match the effect of doubling (resp. halving) the gain factor $G_{min}$(k).

That is, for as long as the applied gain $G_{var}$(k) is varying, the changes in the applied gain are matched by changing the noise suppression minimum gain from a current value ($G_{min}$)) to a new value $G_{new}$, the new value $G_{new}$ being the value the noise suppression lower limit reaches when the applied gain levels off—e.g. at frame "k+3" in FIG. 6B: in response to a change in the applied gain $G_{var}$ (k) from a current frame k−1 to the next adjacent frame k (i.e. in whilst $G_{var}$ (k−1) applied to the current frame k−1 is not equal to the gain $G_{var}$ (k) applied to the next adjacent frame k) the noise suppression minimum gain $G_{min}$ (k) as used for that same next frame k is changed accordingly relative to the noise suppression minimum gain used for the current frame $G_{min}$ (k−1) by a factor which is the multiplicative inverse of the fractional change in applied gain (i.e. $[G_{var}(k)/G_{var}(k-1)]^{-1}$) in the linear domain—this can be equivalently expressed as a change equal in magnitude but opposite in sign to the change in the logarithmic domain in dB. This corresponds to step S508 of FIG. 5 and can be seen in FIG. 6A which shows (600 exemplary changes in the gain as applied by the variable gain component 300 at times $t_a$ and $t_b$ being matched (602) by a corresponding, rapid change in the noise suppression minimum gain, the change in the noise suppression minimum gain being equal in magnitude but opposite in sign to the change in the gain as applied by the variable gain component 302. This can also be seen at the frame level in FIG. 6B (602') which shows a change in the applied gain occurring at frame "k" being matched by an equal and opposite change in the noise suppression minimum gain used for that same frame "k". Although for the sake of simplicity 602' shows $G_{min}$ (k) as varying from frame-to-frame but remaining constant across a given frame k, in practice $G_{min}$ (k) may be varied smoothly within frames (from sample-to-sample) e.g. by the noise suppression minimum gain $G_{min}$ (k) being changed on a per-sample basis to match any per-sample changes in the applied gain $G_{var}$ (k) for as long as $G_{var}$ (k) is changing, and/or by the noise suppression minimum gain $G_{min}$ (k) being smoothed on a per-sample basis within frames for as long as $G_{var}$ (k) remains at a constant level. That is, in practice, the aggressiveness of the noise suppression procedure may be varied on a per-sample basis with some or all of the iterations of equation 2 being performed for each audio signal sample rather than for each frame k.

The change in the noise suppression lower limit thus tracks the change in the applied gain such that the change in the applied gain and the change in the noise suppression aggressiveness from the current value to the new value are both rapid and have substantially the same duration.

The term c*[$G_{min}$ (k−1)−$G_{min}$] in the above equation 2 is a first order recursive smoothing term effecting first order recursive smoothing. For as long as the applied gain remains constant from frame to frame following a change (i.e. as long as the gain $G_{var}$ (k−1) applied to the current frame k−1 remains equal to the gain $G_{var}$ (k) applied to the next adjacent frame k), the first order recursive smoothing acts to gradually return the noise suppression minimum gain factor to a constant level of $G_{min}$. Thus, following a change in the applied gain which causes a corresponding and rapid change in the nose suppression minimum gain, the noise suppression minimum gain (and hence the aggressiveness of the noise suppression procedure) is gradually returned to the constant level $G_{min}$. This corresponds to step S510 of FIG. 5 and is illustrated in FIG. 6A where the respective gradual returns following the rapid changes at time $t_a$ and $t_b$ can be seen, and also at the frame level in FIG. 6B following the rapid change at frame "k".

This $G_{min}$ value is chosen as a lower limit which would optimise perceptual quality in the absence of any changes in the gain $G_{var}$ (k) applied by the variable gain component 302. The constant $G_{min}$ may, for instance, take a value of −12 dB or thereabouts (that is, an attenuation of +12 dB or thereabouts).

The smoothing factor c is chosen to effect a gradual return to the constant level $G_{min}$. That is, such that the noise suppression lower limit $G_{min}$ (k) varies as a second function of time (substantially shallower than the first function of time) having a second time constant $\tau_2$ which is substantially longer than that of the preceding rapid change in the noise suppression lower limit, the second time constant $\tau_2$ being around e.g. 10-40 seconds ($>>\tau_1 \approx$50-250 ms) such that it takes around 10-40 seconds for $G_{min}$(k) to change by (1−1/e)≈63% of a difference $\Delta_2 = G_{min} - G_{new}$ between the constant value $G_{min}$ and the new value $G_{new}$ (the total change in aggressiveness) i.e. such that it takes $\tau_2 \approx$10-40 seconds for $G_{min}$(k) to change from $G_{new}$ to $G_{new}+\Delta_2*(1-1/e)$. When the noise suppression minimum gain $G_{min}$ (k) is smoothed as per line 2 of equation 2, the gain factor returns exponentially towards the constant $G_{min}$ as $G_{min}-\Delta_2 * e^{-(t-t'_0)/\tau_2}$ (this being the second function of time, the second function being substantially exponential) where t represents time and the gradual return begins at a time $t'_0$; the smoothing parameter c determines the second time constant $\tau_2$ and c is chosen such $\tau_2 \approx 10\text{-}40$ seconds.

During this time, the level of the noise component remaining in the noise reduced signal estimate $y_{nr}$ (t) will vary, but will do so gradually due to the gradual change in $G_{min}$ (k) and will thus be less noticeable to the user.

Figure 6C:
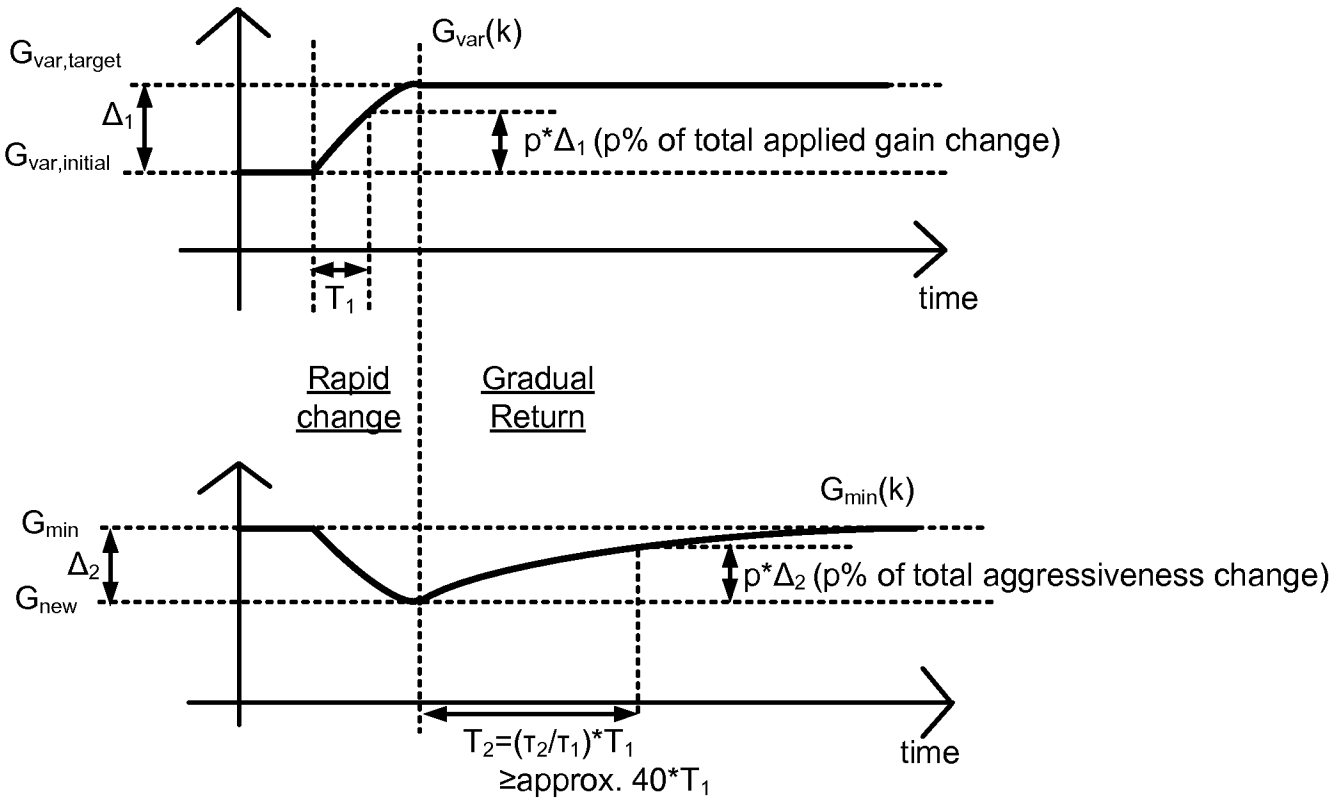
FIG. 6C is another schematic illustration of a time-varying applied gain and a time-varying noise suppression minimum gain.

The rapid change in the applied gain (which has substantially the same duration as the rapid change in aggressiveness) is thus faster than the subsequent gradual return by a factor of about $\tau_2/\tau_1$—that is, the applied gain (partially) changes by a fraction $0<p<1$ (i.e. a percentage $0\%<p\%<100\%$) of the total change in applied gain (i.e. changes from the initial value $G_{var,initial}$ to an intermediate gain value $G_{var,initial}+\Delta_1*p$) over a first time interval $T_1$ and the aggressiveness of the noise suppression procedure (partially) changes by that same fraction p but of the total change in aggressiveness (i.e. changes from the new value $G_{new}$ to an intermediate aggressiveness value $G_{new}+\Delta_2*p$) over a second time interval $T_2$, the second interval $T_2$ being longer than the first time interval $T_1$ by a factor of $\tau_2/\tau_1$ (i.e. $T_2=(\tau_2/\tau_1)*T_1 \geq$approx. 40). This is true for different values of p in the range (0,1) (i.e. for different percentages in the range (0%, 100%) e.g. 1%, 5%, 10%, 20%, 50%, 70%, 90% etc.). This is illustrated in FIG. 6C. In other words, completing a percentage p of the subsequent gradual return of the noise suppression aggressiveness from the new value to the current value takes about 40 times (or more) longer than completing that same percentage p of the initial rapid change in the applied gain from the initial value to the target value.

As the gradual return of the noise suppression aggressiveness has a second time constant $\tau_2$ of no less than about 10 seconds and the rapid change in the noise suppression aggressiveness has a first time constant $\tau_1$ of no greater than about 250 ms=0.25 seconds, $$\frac{\tau_2}{\tau_1} \geq approx.\frac{10}{0.25} = 40$$

—that is, the second interval is longer than the first interval by at least a factor of about 40.

The time it takes a first-order auto-regressive smoother (with exponential output after changes)—e.g. as effected by equation 1 or line 2 of equation 2—to approach the input value by a certain relative amount (p %) will only depend on the time constant ($\tau_1$, $\tau_2$) defined by the filter coefficient (smoothing parameter b, c) and not the size of the change (in gain/aggressiveness). The time constant ($\tau_1$, $\tau_2$) is how the convergence time of a first order smoother is usually described; that is the smoother of equation 1 has a convergence time of the first time constant $\tau_1$ and the smoother of equation 2, line 2 has a convergence time of the second time constant $\tau_2$ substantially longer than the first (by at least a factor of about 40).

From a strict mathematical point of view, the first and second functions would, if left 'unchecked', take an infinite amount of time to converge to the target gain value $G_{var,target}$ and the constant noise suppression minimum level $G_{min}$ respectively (which are asymptotic values). This will of course not be the case in reality e.g. due to rounding errors. That it strictly speaking takes infinite amount of time to reach the input value, is of negligible importance—this is acceptable (as are rounding errors making the convergence happen earlier), and the output of the smoother is kept 'on-track' by the input regardless.

The aggressiveness is changed from the initial value to substantially the current value over a first (finite) duration ($\Delta t_1$ in FIG. 6A) substantially the same as that of the change in applied gain, and such that the aggressiveness is returned to substantially the current value over a second (finite) duration ($\Delta t_2$ in FIG. 6A) substantially longer than the first duration. For a typical gain change (e.g. in the order of 1 dB), the first duration may typically be no more than, say, about 250 ms (e.g. between about 50 ms and about 250 ms) and the second duration may typically be no less than, say, about 10 seconds (e.g. between about 10 seconds and about 40 seconds). Thus, for a typical change in applied gain, the second duration may be longer than the first by at least a factor of about 40 (10 seconds/250 ms). In this embodiment, the first and second durations vary depending on the size of size of the change in applied gain (and are both shorter for a lower magnitude of the change in applied gain and longer for a higher magnitude of the change in applied gain).

In general, the first duration is sufficiently short to counteract the effect that the change in applied gain would otherwise have on the noise level, and the second duration is sufficiently long to ensure that the eventual change in the nose level is perceptibly slower than it would otherwise be as a result of the change in applied gain.

As an example, if the applied gain is increased by 3 dB, the noise suppression component 312 would be applying 15 dB of noise suppression rapidly afterwards (that is the applied noise suppression gain lower limited by −15 dB), gradually and smoothly returning to a less aggressive suppression of e.g. 12 dB over the next 20 seconds or so. Conversely, if the applied gain is decreased by 3 dB, the noise suppression component 312 would be applying 9 dB of noise suppression (that is the applied noise suppression gain lower limited by −9 dB), gradually and smoothly returning to a more aggressive suppression of e.g. 12 dB over the next 20 seconds or so.

Figure 7:
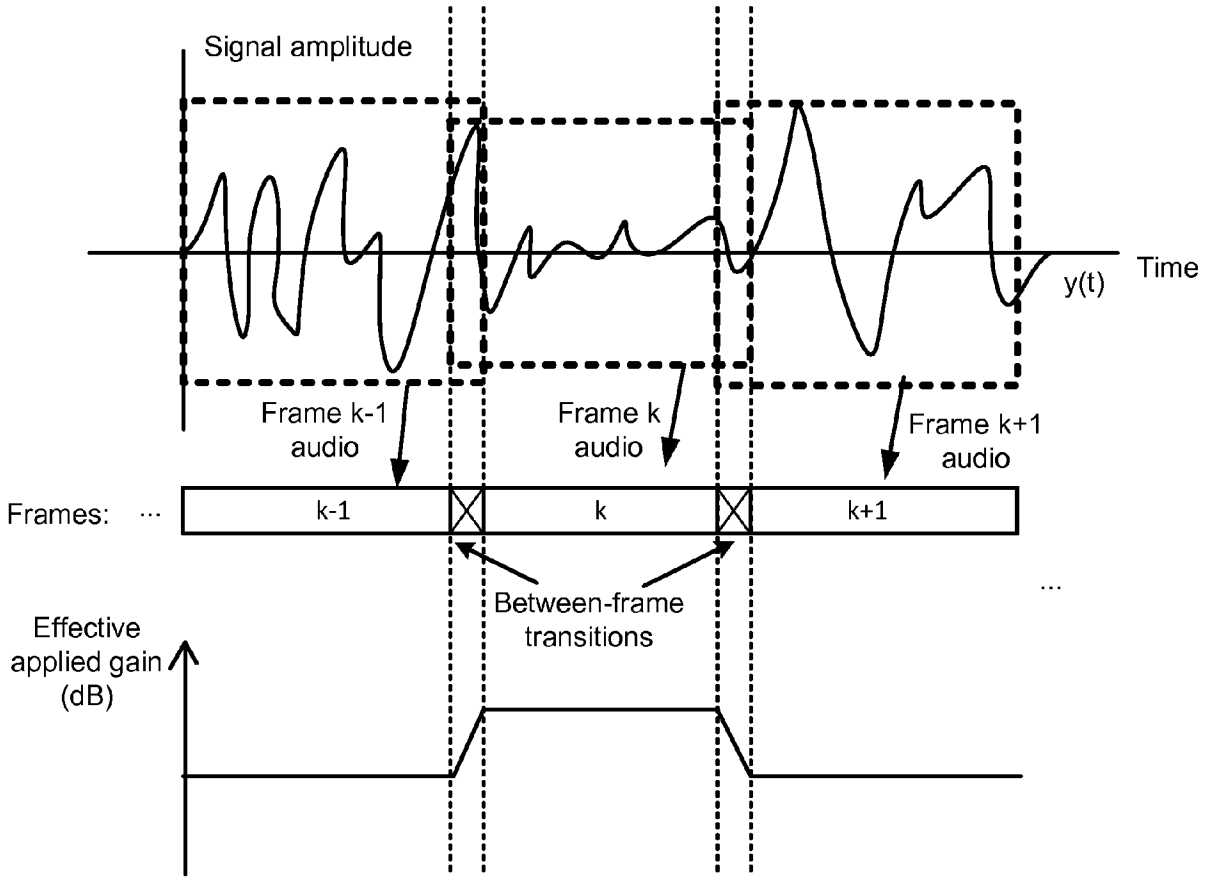
FIG. 7 is a schematic illustration of overlapping audio frames.

In practice, it may be desirable for frames k, k+1, k+2 . . . to overlap to some extent. This overlap may, for instance, be of order 25% to 50% of the frame length (which may around 5 ms to 20 ms) which means an overlap of order 1.25 ms-10 ms. That is, the audio signal y(t) is segmented into audio frames such that an initial portion of audio in frame k is replicated as a final portion of the next frame k+1 etc.—this is illustrated in FIG. 7 which illustrates three exemplary frames k−1, k, k+1 containing partially overlapping portions of the audio signal y(t). Frames can then be combined after processing e.g. by linear interpolation of any overlapping intervals of adjacent frames, effectively 'fading' from one frame to the next frame to generate an audio signal having correct timing. Such frame overlap techniques are known in the art and can illuminate or reduce audible artefacts that might otherwise occur due to discontinuity between neighbouring frames arising from processing or otherwise.

Whilst in the above, the change in applied gain is a 'smooth' change, in principle the applied gain could be changed as a step function from one frame to the next adjacent frame. In this case, when the applied gain factor $G_{var}$ (k) is changed from one frame to the next as a step function, a consequence of the frame overlap is to nonetheless effectively 'smooth' this step function such that the applied gain effectively varies substantially continuously from an initial value to a target value over an interval of time equal to the frame overlap (of order 1 ms-10 ms), as illustrated in FIG. 7. Similarly, although the noise suppression minimum gain factor $G_{min}$ (k) is changed as a step function from that one frame to that next frame to match the change in the applied gain factor $G_{var}$ (k), the frame overlap of the clean-signal-estimate frames means that this the change in noise suppression minimum gain is similarly effectively 'smoothed' between these frames such that a change in the noise suppression minimum gain $G_{min}$ (k) from a current value to a new value—and thus the change in the aggressiveness of the noise suppression procedure—can be considered as effectively taking place over an interval equal to the frame overlap. This is of order 1 ms-10 ms—again, significantly less than the gradual return to the current value which, as discussed, takes place over an interval of order 10 seconds or more.

As used herein, the phrase "changing the aggressiveness of the noise suppression procedure by an amount substantially matching the change in the applied gain" (or similar) is used to mean that the change in aggressiveness matches (i.e. counteracts) the effect of the change in applied gain on the noise component (more specifically, when the change in aggressiveness substantially counteracts the effect of the change in applied gain on the level of the noise component such that the level of the noise component in the noise reduced signal is substantially unchanged immediately following the change in applied gain).

This does not necessarily mean that there is any one particular numerical relationship between the magnitudes of the changes and, in particular, does not necessarily mean that the respective magnitudes of the changes are equal (this may or may not be the case). For instance, a change of 1 dB in the applied gain from 1 dB to 2 dB could be matched by changing the noise suppression aggressiveness by −1 dB (e.g. from −12 dB to −13 dB)—in this case the effect of the applied gain change is matched by an aggressiveness change of equal magnitude in dB. However, a change of in the applied gain from 1 to 2 in the linear domain (which is a change of 2−1=1 in the linear domain) could be matched by changing the noise suppression aggressiveness from e.g. 0.25 to ½*0.25=0.125 in the linear domain (which is a change of 0.25−0.125=0.125 in the linear domain)—in this case the effect of the applied gain change is matched by an aggressiveness change which is not equal in magnitude to the change in applied gain. Further, the applied gain could in principle be implemented in one domain (e.g. linear domain or logarithmic domain) and the noise suppression could be implemented in a different domain (e.g. logarithmic domain or linear domain) in which cast the respective changes in in the different domains are unlikely to be equal in magnitude. That is, the change in the aggressiveness substantially matches the change in applied gain when the effect of the former is matched by the latter regardless of the respective domains in which the gain and noise suppression procedure are applied.

Whilst in the above-described method of FIG. 5, a noise suppression component is configured to apply a noise suppression procedure to an audio signal to generate a noise reduced signal estimate, and a variable gain component is configured to apply a gain to the noise reduced signal estimate, in alternative embodiment this ordering may be reversed. That is, a variable gain component may be configured to apply a gain to an audio signal to generate a gain adjusted signal, and a noise suppression component may be configured to apply a noise suppression procedure to the gain adjusted signal. In both cases, the variable gain component and the noise suppression component are connected in series and constitute a signal processing chain configured to generate a gain adjusted, noise reduced audio signal from a noisy audio signal. Moreover, in either case, as indicated above, that chain may comprise other signal processing components configured to perform additional signal processing, including intermediate processing occurring in between the noise reduction and gain application such that one of the noise suppression component and the variable component do not act on the output of the other directly but rather such that the output of one is supplied to the other via intermediate signal processing components and is thus subject to intermediate signal processing after processing by the one and before processing by the other. In the case that there are additional intermediate signal processing components connected between the components 302 and 312 in the signal processing chain (that is, in the case that additional processing is performed following the gain adjustment but prior to the noise suppression or in the case that additional processing is performed following the nose suppression but prior to the gain adjustment), for the avoidance of doubt it should be noted that the variable gain component and the noise suppression component are nonetheless "connected in series" (that is, the gain and the noise reduction are still considered to be "applied in series") within the meaning of the present disclosure notwithstanding the fact that they may be so connected via additional intermediate signal processing components (that is, notwithstanding the fact that additional intermediate signal processing may be performed in between the application of the gain and the application of the noise suppression procedure). In the present context, the terms signal processing components (resp. procedures) "connected (resp. applied) in series" refers to a chain of two or more signal processing components whereby each component of the chain applies a particular type of audio signal processing to an input signal and supplies that processed signal to the next component in the chain for further processing, other than the first and last components which receive as an input an initial audio signal and supply a final output of the chain—each component in such a chain is considered to be connected in series with every other component in the chain.

Moreover, whilst in the above, the gain and noise suppression component are connected in series, it is envisaged that a similar effect could be achieved by gain/noise suppression components connected in parallel i.e. with at least one gain component and at least one noise suppression component each acting 'directly' on the noisy audio signal—rather than one acting on the output of the other—to generate separate respective outputs which are then aggregated e.g. as a (possibly weighted) sum to provide a final output audio signal.

Moreover, whilst in the above the disclosed technique is applied to a near-end signal prior to transmission over a communication network to a far-end user, alternatively or additionally the disclosed techniques may be applied to a far-end signal received over the communication network from the far-end user e.g. before being output from a near-end loudspeaker (e.g. 210). That is, an equivalent signal processing chain may perform equivalent processing on an audio signal received from the network 106 before it is output via speaker 210 as an alternative or addition to a signal processing chain performing audios signal processing on an audio signal received from the microphone 212 of device 300 before it is transmitted via network 106. Thus, a signal processing chain may have an input connected to receive an audio signal received via the network 106 from the second user device 108 and an output connected to supply a processed audio signal to the loudspeaker 210 of device 104.

Further, whilst in the above, the aggressiveness of a noise suppression procedure is rapidly changed from a current value to a new value responsive to a change in applied gain, then gradually returned to the current value by first order recursive smoothing, this gradual return can be effected by any number of alternative means. For instance, the gradual change could be a linear change back to the current value with the current value being reached e.g. 10-40 seconds after the change in applied gain, or higher-order recursive smoothing could be employed to effect the gradual return. Similarly, the rapid change in applied gain could be a linear change from the initial value to the target value over a duration of e.g. about 50-250 ms, or higher order recursive smoothing could be employed to effect the rapid change.

The noisy audio signal may be received as a plurality of (discrete) portions (e.g. audio frames or audio samples) and the aggressiveness and gain may be updated at most per portion (i.e. new values thereof may be calculated at most per portion with one calculated value being used for the entirety of a given portion).

Further, whilst in the above, the subject matter is described in the context of a real-time communication system, it will be appreciated that the disclosed techniques can be employed in many other contexts, both in relation to 'live' and pre-recorded noisy audio signals. Further, whilst in the above the subject matter is implemented by an audio signal processing device in the form of user device (such as a personal computer, laptop, tablet, smartphone etc.), in alternative embodiments the subject matter could be implemented by any form of audio signal processing device such as a dedicated audio signal processing device e.g. an audio effects unit, rack-mounted or otherwise.

Generally, any of the functions described herein can be implemented using software, firmware, hardware (e.g., fixed logic circuitry), or a combination of these implementations. The terms "module," "functionality," "component" and "logic" as used herein generally represent software, firmware, hardware, or a combination thereof. This includes, for example, the components of FIGS. 3 and 4 above. In the case of a software implementation, the module, functionality, or logic represents program code that performs specified tasks when executed on a processor (e.g. CPU or CPUs), such as tasks to implement the method steps of FIG. 5 (although these steps of FIG. 5 could be implemented by any suitable hardware, software, firmware or combination thereof). The program code can be stored in one or more computer readable memory devices. The features of the techniques described below are platform-independent, meaning that the techniques may be implemented on a variety of commercial computing platforms having a variety of processors.

For example, the user devices may also include an entity (e.g. software) that causes hardware of the user devices to perform operations, e.g., processors functional blocks, and so on. For example, the user devices may include a computer-readable medium that may be configured to maintain instructions that cause the user devices, and more particularly the operating system and associated hardware of the user devices to perform operations. Thus, the instructions function to configure the operating system and associated hardware to perform the operations and in this way result in transformation of the operating system and associated hardware to perform functions. The instructions may be provided by the computer-readable medium to the user devices through a variety of different configurations.

One such configuration of a computer-readable medium is signal bearing medium and thus is configured to transmit the instructions (e.g. as a carrier wave) to the computing device, such as via a network. The computer-readable medium may also be configured as a computer-readable storage medium and thus is not a signal bearing medium. Examples of a computer-readable storage medium include a random-access memory (RAM), read-only memory (ROM), an optical disc, flash memory, hard disk memory, and other memory devices that may us magnetic, optical, and other techniques to store instructions and other data.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. An audio signal processing device comprising:

an input for receiving a noisy audio signal having a desired audio component and a noise component; and a variable gain component and a noise suppression component respectively configured to apply a gain and a noise suppression procedure to the noisy audio signal, thereby generating a gain adjusted noise reduced audio signal;

wherein an aggressiveness of the noise suppression procedure is changed from a current noise suppression value, automatically and without user intervention and responsive to a change in an applied gain, by an amount substantially matching the change in applied gain to a new noise suppression value, and then returned to the current noise suppression value;

wherein the change in the applied gain is effected by recursively smoothing the applied gain over multiple portions of the noisy audio signal from an initial gain value to a target gain value, and wherein the applied gain is smoothed with a first convergence time and the aggressiveness of the noise suppression procedure is smoothed with a second convergence time longer than the first convergence time.

2. An audio signal processing device according to claim 1 wherein the noise suppression component is configured to apply a limited noise suppression gain to the audio signal, the limited noise suppression gain being a maximum of an unlimited noise suppression gain and a noise suppression gain lower limit, and the noise suppression gain lower limit is rapidly changed from the current noise suppression value to the new noise suppression value, and then gradually returned to the current noise suppression value.

3. An audio signal processing device according to claim 2 wherein the noise suppression component is configured to evaluate the unlimited noise suppression gain as a function of an estimate of the noise component.

4. An audio signal processing device according to claim 2 wherein the current noise suppression value of the noise suppression gain lower limit is about −12 dB.

5. An audio signal processing device according to claim 1 wherein the noisy audio signal is received as a plurality of portions constituting a sequence of portions and the aggressiveness is updated at most per portion.

6. An audio signal processing device according to claim 5 wherein the aggressiveness is gradually returned from the new noise suppression value to the current noise suppression value by recursively smoothing the aggressiveness over multiple portions in the sequence from the new noise suppression value to the current noise suppression value.

7. An audio signal processing device according to claim 6 wherein the smoothing is a first order recursive smoothing whereby, for each of said multiple portions, the aggressiveness is calculated for that portion from the current noise suppression value and the aggressiveness previously calculated for one portion immediately preceding that portion in the sequence and not from the aggressiveness previously calculated for any other portions in the sequence.

8. An audio signal processing device according to claim 5 wherein the portions are audio samples or audio frames.

9. An audio signal processing device according to claim 1 wherein the aggressiveness is changed from the current noise suppression value to the new noise suppression value over a first duration between 50 ms and 250 ms.

10. An audio signal processing device according to claim 1 wherein the aggressiveness is returned from the new noise suppression value to the current noise suppression value over a second duration between 10 seconds and 40 seconds.

11. An audio signal processing device according claim 1 wherein the aggressiveness is changed from the current noise suppression value to the new noise suppression value over a first duration the same as that of the change in applied gain.

12. An audio signal processing device according to claim 1 wherein the change in applied gain is from an initial gain value; and wherein a partial change in the applied gain from the initial gain value to an intermediate gain value by a percentage p % of the total change in applied gain is over a first time interval, and a partial change in the aggressiveness from the new noise suppression value to an intermediate noise suppression value by that same percentage p % of the total change in aggressiveness is over a second time interval longer than the first time interval by a factor of at least about forty.

13. An audio signal processing device according to claim 1 wherein the change in applied gain is effected by varying the applied gain as a first function having a time constant no more than about 250 ms.

14. An audio signal processing device according to claim 1 wherein the aggressiveness is returned from the new noise suppression value to the current noise suppression value by varying the aggressiveness as a second function having a time constant of no less than about 10 seconds.

15. An audio signal processing device according to claim 1 further comprising:

a network interface configured to access a communication system and to receive the noisy audio signal from another device of the communication system; and one or more loudspeakers configured to output the gain adjusted noise reduced audio signal.

16. An audio signal processing device according to claim 1 further comprising:

one or more microphones configured to receive an incoming analogue signal and to provide the noisy audio signal to the input; and a network interface configured to access a communication system to transmit the gain adjusted noise reduced audio signal to another device of the communication system.

17. At least one computer readable storage medium storing executable program code configured, when executed, to implement an audio signal processing method comprising:

receiving a noisy audio signal having a desired audio component and a noise component;

generating a gain adjusted noise reduced audio signal by applying a gain and a noise suppression procedure to the noisy audio signal;

changing the aggressiveness of the noise suppression procedure from a current noise suppression value, automatically and without user intervention and responsive to a change in an applied gain, by an amount substantially matching the change in applied gain to a new noise suppression value, wherein the change in the applied gain is effected by recursively smoothing the applied gain over multiple portions of the noisy audio signal from an initial gain value to a target gain value, and wherein the applied gain is smoothed with a first convergence time and the aggressiveness of the noise suppression procedure is smoothed with a second convergence time longer than the first convergence time; and returning the aggressiveness of the nose suppression procedure from the new noise suppression value to the current noise suppression value.

18. An audio signal processing method comprising:

receiving a noisy audio signal having a desired audio component and a noise component;

generating a gain adjusted noise reduced audio signal by applying a gain and a noise suppression procedure to the noisy audio signal;

changing an aggressiveness of the noise suppression procedure from a current noise suppression value, automatically and without user intervention and responsive to a change in an applied gain, by an amount substantially matching the change in applied gain to a new noise suppression value, wherein the change in the applied gain is effected by recursively smoothing the applied gain over multiple portions of the noisy audio signal from an initial gain value to a target gain value, and wherein the applied gain is smoothed with a first convergence time and the aggressiveness of the noise suppression procedure is smoothed with a second convergence time longer than the first convergence time; and returning the aggressiveness of the noise suppression procedure from the new noise suppression value to the current noise suppression value.

19. An audio signal processing method according to claim 18, wherein the change in applied gain is effected by varying the applied gain as a function having a time constant no more than about 250 ms.

20. An audio signal processing method according to claim 18, wherein the change in applied gain is effected by varying the applied gain as a first function having a time constant no more than about 250 ms, and the aggressiveness of the noise suppression procedure is returned to the current noise suppression value by varying the aggressiveness as a second function having a time constant of no less than about 10 seconds.

* * * * *